US010907842B2

(12) United States Patent
Nunes

(10) Patent No.: US 10,907,842 B2
(45) Date of Patent: Feb. 2, 2021

(54) HUMIDIFIER ASSEMBLY

(71) Applicant: David Nunes, Boise, ID (US)

(72) Inventor: David Nunes, Boise, ID (US)

( * ) Notice: Subject to any disclaimer, the term of this patent is extended or adjusted under 35 U.S.C. 154(b) by 174 days.

(21) Appl. No.: 16/123,679

(22) Filed: Sep. 6, 2018

(65) Prior Publication Data

US 2020/0080735 A1 Mar. 12, 2020

(51) Int. Cl.

| | |
|---|---|
| ***F24F 6/18*** | (2006.01) |
| ***F24H 9/00*** | (2006.01) |
| ***F24F 13/22*** | (2006.01) |
| *F24F 6/00* | (2006.01) |

(52) U.S. Cl.

CPC ..... *F24F 6/18* (2013.01); *F24F 13/22* (2013.01); *F24H 9/0052* (2013.01); *F24F 2006/008* (2013.01)

(58) Field of Classification Search

CPC ..... F24F 6/02; F24F 13/22; F24H 8/006
USPC ..... 126/113
See application file for complete search history.

(56) References Cited

U.S. PATENT DOCUMENTS

| | | | | |
|---|---|---|---|---|
| 3,472,496 | A | 10/1969 | Coleman et al. | |
| 4,139,762 | A * | 2/1979 | Pohrer | F24F 6/18 126/113 |
| D261,421 | S | 10/1981 | Morrow | |
| 4,706,884 | A | 11/1987 | Brauer | |
| 5,570,680 | A | 11/1996 | Payne | |
| 5,758,018 | A | 5/1998 | Fowler, Jr. | |
| 5,765,544 | A | 6/1998 | Vigansky, Jr. | |
| 6,354,572 | B1 | 3/2002 | Menassa | |
| 6,394,427 | B1 | 5/2002 | Guetersloh et al. | |
| D458,356 | S | 6/2002 | Redner et al. | |
| 2002/0070465 | A1 | 6/2002 | Harvel et al. | |
| 2002/0070466 | A1 | 6/2002 | Harvel | |
| 2012/0152513 | A1 | 6/2012 | Dempsey et al. | |
| 2012/0247453 | A1* | 10/2012 | Wen | A23L 3/40 126/572 |
| 2016/0215991 | A1* | 7/2016 | Nunes | F24F 6/02 |

* cited by examiner

*Primary Examiner* — Steven B McAllister
*Assistant Examiner* — Aaron H Heyamoto

(57) ABSTRACT

A humidifier assembly for capturing moisture from the furnace and releasing the moisture into an area includes a furnace. A housing is coupled to the furnace. An inlet is coupled to the housing. The inlet is coupled to a drain line on the furnace. Condensation from the furnace is directed into the housing. A filter is removably coupled to the housing. The filter captures the condensation from the furnace and converts the condensation into an evaporate. The evaporate is released into the furnace. An outlet is coupled to the housing. An overflow line is coupled to the outlet. A reservoir is coupled to the overflow line to capture excess condensation. A secondary reservoir is fluidly coupled to the reservoir. A heating element in the secondary reservoir generates steam delivered to discharge ductwork of the furnace.

9 Claims, 5 Drawing Sheets

HUMIDIFIER ASSEMBLY

BACKGROUND OF THE DISCLOSURE

Field of the Disclosure

The disclosure relates to humidifier devices and more particularly pertains to a new humidifier device for capturing moisture from the furnace and releasing the moisture into an area wherein a high efficiency condensing gas furnace to be used without a drain present.

SUMMARY OF THE DISCLOSURE

An embodiment of the disclosure meets the needs presented above by generally comprising a housing that may be coupled to a furnace. An inlet is coupled to the housing. The inlet is coupled to a drain line on the furnace. Condensation from the furnace is directed into the housing. A filter is removably coupled to the housing. The filter captures the condensation from the furnace and converts the condensation into an evaporate. The evaporate is released into the furnace. An outlet is coupled to the housing. An overflow line is coupled to the outlet. A reservoir is coupled to the overflow line to capture excess condensation. A secondary reservoir is fluidly coupled to the reservoir. A heating element in the secondary reservoir generates steam delivered to discharge ductwork of the furnace.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
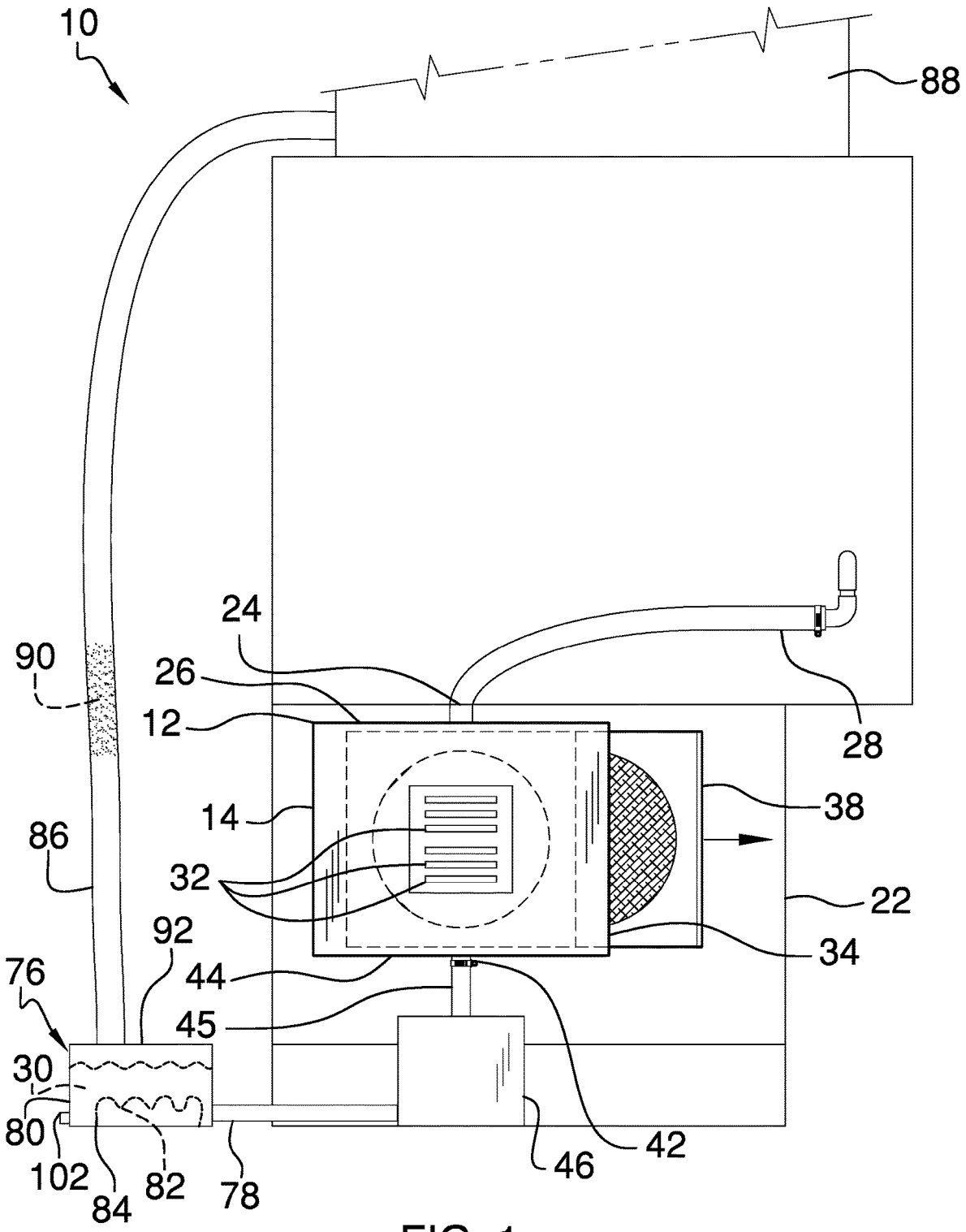
FIG. 1 is a front view of a humidifier assembly according to an embodiment of the disclosure.
Figure 2:
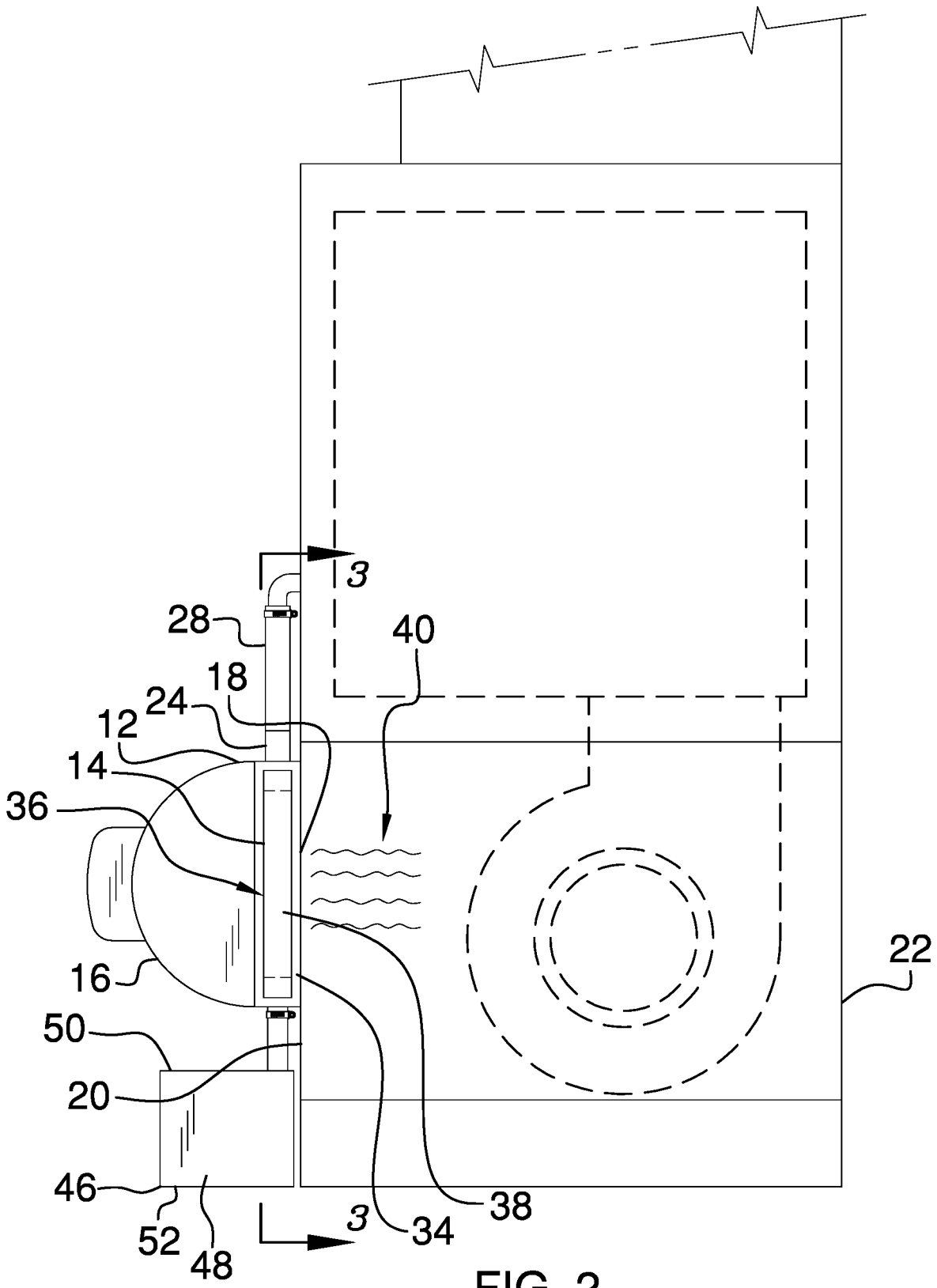
FIG. 2 is a left side view of an embodiment of the disclosure.
Figure 3:
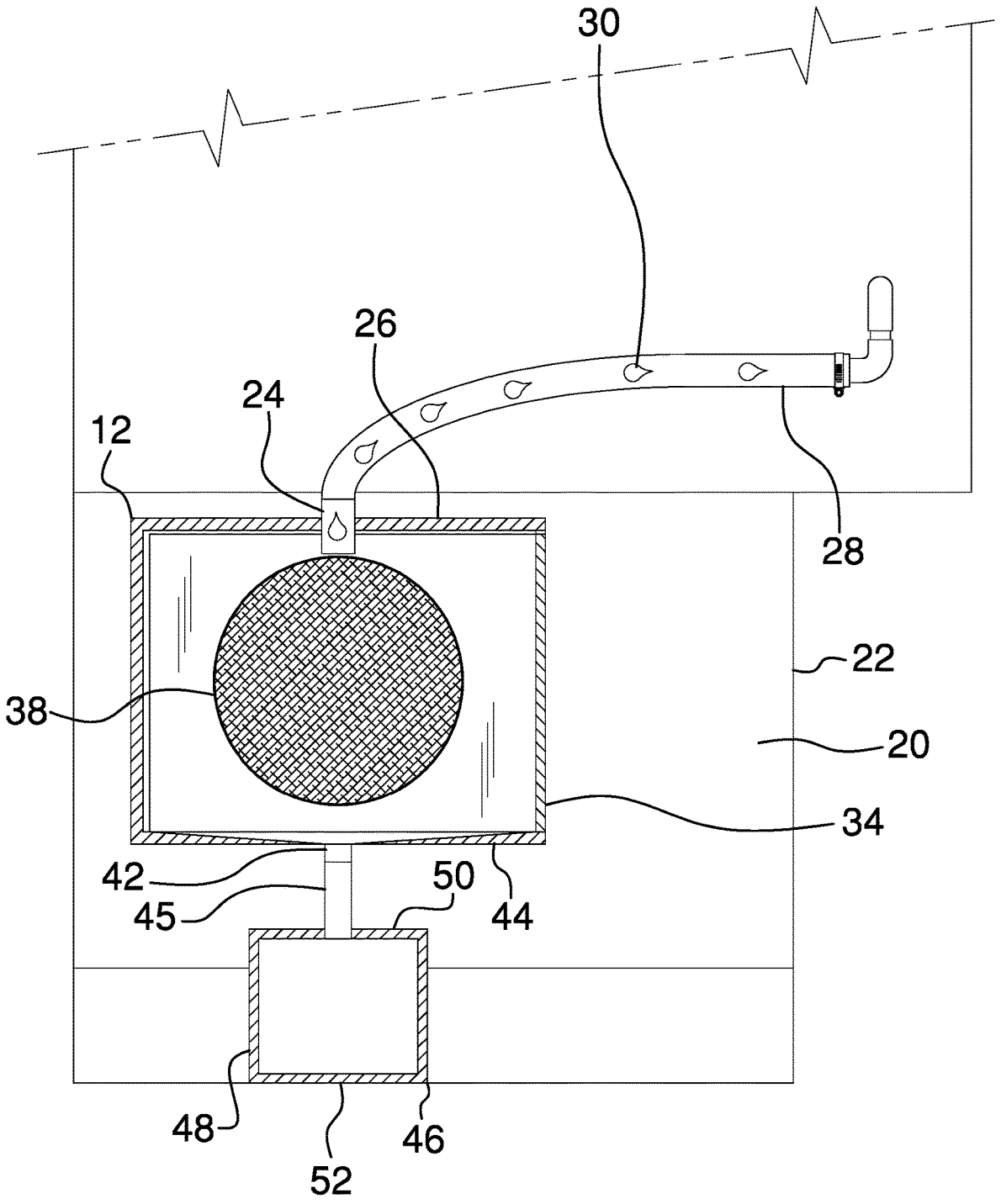
FIG. 3 is a cross sectional view taken along line 3-3 of FIG. 2 of an embodiment of the disclosure.
Figure 4:
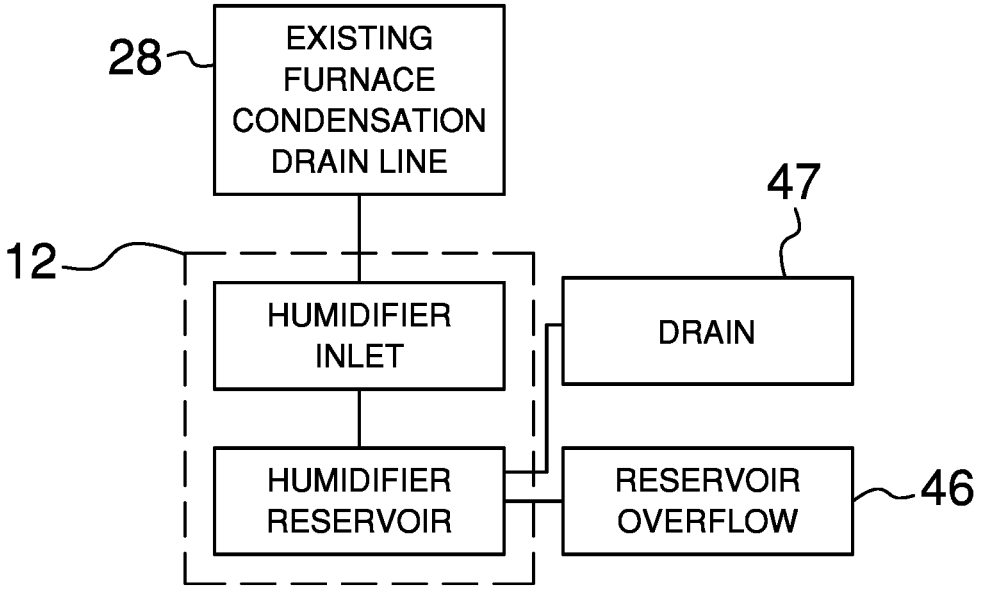
FIG. 4 is a schematic view of an embodiment of the disclosure.
Figure 5:
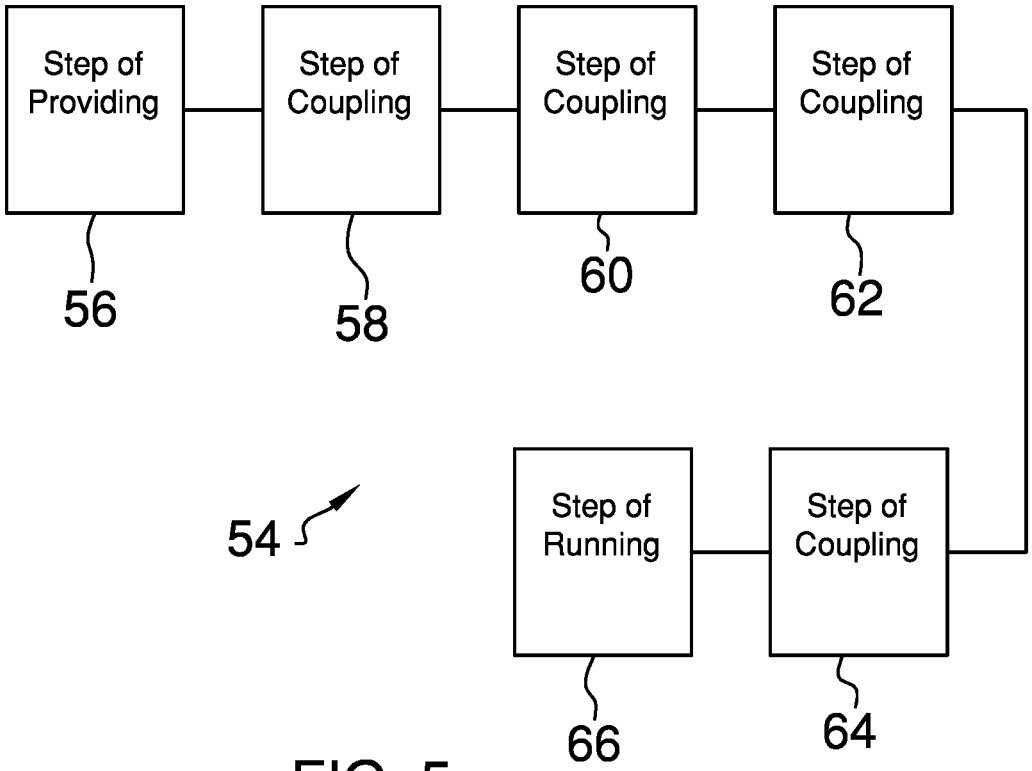
FIG. 5 is a schematic view of a method of utilizing an embodiment of the disclosure.
Figure 6:
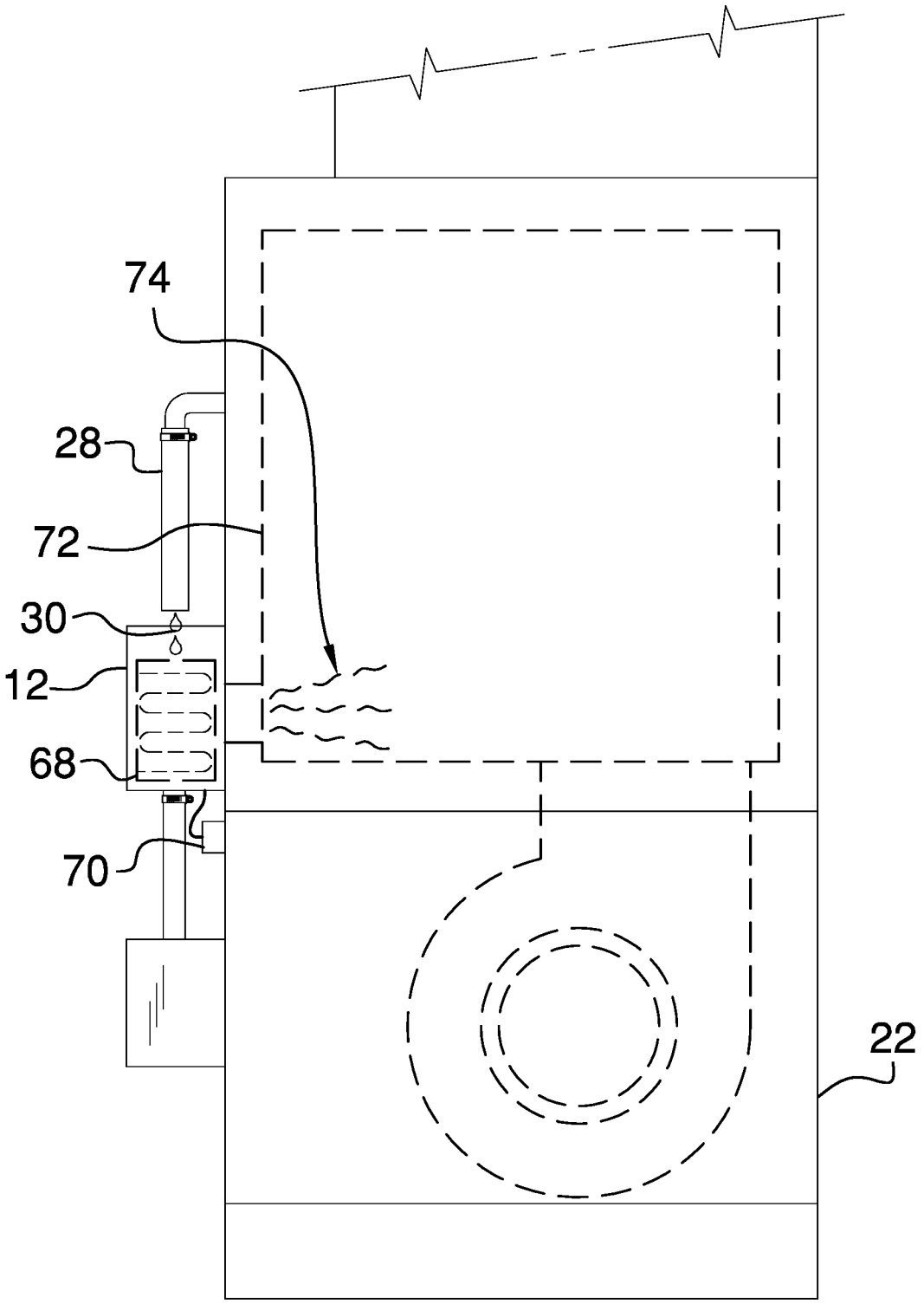
FIG. 6 is a perspective view of an alternative embodiment of the disclosure.

With reference now to the drawings, and in particular to FIGS. 1 through 5 thereof, a new humidifier device embodying the principles and concepts of an embodiment of the disclosure and generally designated by the reference numeral 10 will be described.

As best illustrated in FIGS. 1 through 5, the humidifier assembly 10 generally comprises a housing 12. The housing 12 has an exterior wall 14 extending between a front wall 16 and a back wall 18 of the housing 12. The housing 12 is substantially hollow. The back wall 18 of the housing 12 is coupled to an outer wall 20 of a furnace 22. The furnace 22 may be a high efficiency gas furnace of any conventional design.

An inlet 24 is fluidly is coupled to a top side 26 of the exterior wall 14 of the housing 12. The inlet 24 is in fluid communication with an interior of the housing 12. The inlet 24 is fluidly coupled to a drain line 28 on the furnace 22. Condensation 30 from the furnace 22 is directed into the housing 12. The condensation 30 may be water. A first lateral side 34 of the exterior wall 14 of the housing 12 has a filter slot 36 extending therethrough. A filter 38 is removably insertable into the filter slot 36.

The filter 38 captures the condensation 30 from the furnace 22. Moreover, the filter 38 converts the condensation 30 into an evaporate 40. The filter 38 may be an evaporative filter of any conventional design. The filter 38 releases the evaporate 40 into the furnace 22. The evaporate humidifies the air distributed by the furnace 22.

An outlet 42 is fluidly coupled to a bottom side 44 of the exterior wall 14 of the housing 12. The outlet 42 is in fluid communication with the interior of the housing 12. An overflow line 45 is coupled to the outlet 42. The overflow line 45 is routed to a drain 47. The drain 47 may be a floor drain or the like. Excess condensation 30 is directed outwardly from the housing 12 into the drain 47.

A reservoir 46 is provided. The reservoir 46 has an outside wall 48 extending between an upper wall 50 and a lower wall 52 of the reservoir 46. The overflow line 45 is fluidly coupled to the upper wall 50 of the reservoir 46. The reservoir 46 captures excess condensation 30. A secondary reservoir 76 is positioned adjacent to the furnace 22 and is fluidly coupled to the reservoir 46 to receive the excess condensation 30 by way of a substantially horizontally oriented reservoir transfer pipe 78. The secondary reservoir 76 has a sidewall 80 and the excess condensation 30 received from the reservoir 46 through the reservoir transfer pipe 78 is received into the secondary reservoir 76 through the sidewall 80. A drain plug 102 is inserted into the sidewall 80 of the secondary reservoir 76 to allow for draining of the secondary reservoir 76 when desired. A heating element 82 is positioned in the secondary reservoir 76 adjacent to a bottom 84 of the secondary reservoir 76. The heating element 82 may be electrically powered. The secondary reservoir 76 has a topmost wall 82 coupled to the sidewall 80. A steam pipe 86 is coupled to extend between the topmost wall 92 and discharge ductwork 88 of the furnace 22. The heating element 82 converts the excess condensation 30 within the secondary reservoir 76 into steam 90 which rises through the steam pipe 86 to be delivered directly into the discharge ductwork 88 to humidify air in the discharge ductwork 88.

In use, a method 54 of capturing the condensation 30 from the furnace 22 and using the condensation 30 to humidify the area includes a step 56 of providing the housing 12 that has the inlet 24 and the outlet 42, the overflow line, the filter 38 and the reservoir 46. The method 54 further includes a step 58 of coupling the housing 12 to the furnace 22. Additionally, the method 54 includes a step 60 of fluidly coupling the drain line 28 on the furnace 22 to the inlet 24. The method 54 includes a step 62 of coupling the drain line 28 to the outlet 42. Continuing, the method 54 includes a step 64 of coupling the reservoir 46 to the drain line 28. The method 54 also includes a step 66 coupling the secondary reservoir 76 to the reservoir 46 and the steam pipe 86 to the discharge ductwork 88 of the furnace 22. Another step 68 is running the furnace 22 so the housing 12 captures the condensation 30 from the furnace 22. The filter 38 converts the condensation 30 to the evaporate 40 so the evaporate 40 is released into the area while excess condensation 30 is converted to steam 90 in the secondary reservoir 76 which is in turn delivered into the discharge ductwork 88.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A humidifier assembly configured to be coupled to a furnace such that said humidifier captures moisture from the furnace and releases the moisture into an area, said assembly comprising:

a furnace;

a housing configured to be coupled to said furnace;

an inlet coupled to said housing, said inlet being coupled to a drain line on said furnace such that condensation from said furnace is directed into said housing;

a filter removably coupled to said housing, said filter capturing the condensation from said furnace and converting the condensation into an evaporate such that the evaporate is released into air urged by said furnace; and an outlet coupled to said housing;

an overflow line coupled to said outlet such that excess condensation is directed outwardly from said housing;

a reservoir coupled to said overflow line such that said reservoir captures the excess condensation;

a secondary reservoir fluidly coupled to said reservoir to receive said excess condensation, said secondary reservoir being fluidly coupled to said reservoir by a horizontally oriented reservoir transfer pipe;

a heating element positioned in said secondary reservoir wherein said excess condensation within said secondary reservoir is converted to steam; and a steam pipe coupled to and extending between said secondary reservoir and discharge ductwork of said furnace wherein steam generated within said secondary reservoir by said heating element is delivered into said discharge ductwork.

2. The assembly according to claim 1, further comprising said housing having an exterior wall extending between a front wall and a back wall of said housing, said housing being substantially hollow, said back wall of said housing being coupled to an outer wall of said furnace.

3. The assembly according to claim 2, further comprising said inlet being fluidly coupled to a top side of said exterior wall of said housing such that said inlet is in fluid communication with an interior of said housing.

4. The assembly according to claim 2, further comprising a first lateral side of said exterior wall of said housing having a filter slot extending therethrough.

5. The assembly according to claim 4, further comprising said filter being removably insertable into said filter slot.

6. The assembly according to claim 5, further comprising said filter releasing the evaporate into said furnace to humidify air distributed by said furnace.

7. The assembly according to claim 2, further comprising said outlet being fluidly coupled to a bottom side of said exterior wall of said housing such that said outlet is in fluid communication with an interior of said housing.

8. The assembly according to claim 1, further comprising said reservoir having an outside wall extending between an upper wall and a lower wall of said reservoir, said overflow line being fluidly coupled to said upper wall of said reservoir.

9. A humidifier assembly configured to be coupled to a furnace such that said humidifier captures moisture from the furnace and releases the moisture into an area, said assembly comprising:

a furnace;

a housing having an exterior wall extending between a front wall and a back wall of said housing, said housing being substantially hollow, said back wall of said housing being coupled to an outer wall of said furnace;

an inlet fluidly coupled to a top side of said exterior wall of said housing such that said inlet is in fluid communication with an interior of said housing, said inlet being fluidly coupled to a drain line on said furnace such that condensation from said furnace is directed into said housing;

a first lateral side of said exterior wall of said housing having a filter slot extending therethrough;

a filter being removably insertable into said filter slot, said filter capturing the condensation from said furnace and converting the condensation into an evaporate, said filter releasing the evaporate into air urged by said furnace to humidify the air distributed by said furnace;

an outlet fluidly coupled to a bottom side of said exterior wall of said housing such that said outlet is in fluid communication with said interior of said housing;

an overflow line coupled to said outlet such that excess condensation is directed outwardly from said housing;

a reservoir having an outside wall extending between an upper wall and a lower wall of said reservoir, said overflow line being fluidly coupled to said upper wall of said reservoir such that said reservoir captures the excess condensation;

a secondary reservoir fluidly coupled to said reservoir to receive said excess condensation, said secondary reservoir being fluidly coupled to said reservoir by a horizontally oriented reservoir transfer pipe;

a heating element positioned in said secondary reservoir wherein said excess condensation within said secondary reservoir is converted to steam; and a steam pipe coupled to and extending between said secondary reservoir and discharge ductwork of said furnace wherein steam generated within said secondary reservoir by said heating element is delivered into said discharge ductwork.

* * * * *